US006796464B1

(12) United States Patent
Tung

(10) Patent No.: US 6,796,464 B1
(45) Date of Patent: Sep. 28, 2004

(54) MULTI-FUNCTIONAL FINGER-PRESS STRUCTURE OF A SPRAY CAN

(76) Inventor: Ching-Sung Tung, PO Box 82-144, Taipei (TW)

( * ) Notice: Subject to any disclaimer, the term of this patent is extended or adjusted under 35 U.S.C. 154(b) by 0 days.

(21) Appl. No.: 10/434,184

(22) Filed: May 9, 2003

(51) Int. Cl.[7] ..... B65D 83/00

(52) U.S. Cl. ..... 222/402.17; 222/402.13; 222/536; 239/337; 239/587.6

(58) Field of Search ..... 222/402.1, 402.11–402.14, 222/402.21–402.23, 402.17, 402.19, 536, 635; 239/337, 338, 587.4–587.6

(56) References Cited

U.S. PATENT DOCUMENTS 2,537,226 A * 1/1951 Lindsey ..... 239/337
3,116,856 A * 1/1964 Prussin et al. ..... 222/402.24
3,148,806 A * 9/1964 Meshberg ..... 222/402.11
3,221,950 A * 12/1965 O'Donnell ..... 222/402.11
3,402,862 A * 9/1968 Meshberg ..... 222/402.11
4,690,312 A * 9/1987 Crapser et al. ..... 222/402.17
5,065,909 A * 11/1991 Pino et al. ..... 222/484
5,242,079 A * 9/1993 Stephens et al. ..... 220/705
5,660,306 A * 8/1997 Kim ..... 222/83
6,105,826 A * 8/2000 Oursin et al. ..... 222/153.06

* cited by examiner

*Primary Examiner*—J. Casimer Jacyna
(74) *Attorney, Agent, or Firm*—Leong C. Lei

(57) ABSTRACT

A multi-functional finger-press structure of a spray can is disclosed. The structure includes a pressurized can spray cap, a spray head seat, a spray tube mounting seat, a sealing pad, a spray tube and at least one to two spray heads. The top of the pressurized can spray cap is a recessed through slot having the inner edge of one end thereof connected by a connection arm to the spray head seat.

3 Claims, 7 Drawing Sheets

MULTI-FUNCTIONAL FINGER-PRESS STRUCTURE OF A SPRAY CAN

BACKGROUND OF THE INVENTION (a) Technical Field of the Invention

The present invention relates to a multi-functional finger-press structure of a spray can, and in particular, to a spray hose disposed on a pressure spray can. The spray can can be used for spraying of a solution into a narrow gap, and without removal of the spray hose, a wider range of spraying with shorter spraying mouth can be performed (b) Description of the Prior Art There are plenty of pressurized cans or spray cans containing for instance insect repellants, paints, medication, etc to provide convenient application to the users. In operation, a pressing cap has to be mounted onto the finger-press structure of the spray can. After that, the user presses the pressing cap so as to release the contents of the spray can in atomized form. The pressing of the pressing cap urges open the needle valve of the spray can. Generally, the spraying mouth of the spray can is short and a wider area of spraying can be made. However, if there is narrow slit or corner to be sprayed with the spray can, it is very common that this cannot be achieved. In order to solve the drawback, a supplementary spray tube is provided for connection to the spraying mouth, which is to be inserted into the narrow slit and to spray into the slit. However, it is not convenient to withdraw the spray tube all the time whenever it is needed.

Further, in this conventional spray can, where a supplementary spray tube is attached. The body of the spray tube is protruded from the exterior of the spraying cap. As a result, automation in mounting the spraying cap is not possible, and in packaging process, automation in packaging with PE film cannot be employed. Therefore it is more laborious and the mounting of the spray cap has to be done manually. Accordingly, it is an object of the present invention to provide a multi-functional finger-press structure of a spray can which mitigates the drawbacks found in the conventional spray can.

SUMMARY OF THE INVENTION

It is a main object of the present invention to provide a multi-functional finger-press structure of a spray can comprising a pressurized can spray cap, a spray head seat, a spray tube mounting seat, a sealing pad, a spray tube, and at least one to two spray heads, characterized in that the top of the pressurized can spray cap is a recessed horizontal through slot having the inner edge of one end thereof connected by a connection arm to the spray head seat, the spray head seat facing one end of the connection arm is formed into a dual-erected ringed fork body having an abdomen portion mounted with the sealing pad being plugged into the spray tube mounting seat, and the interior of the spray head seat is formed into a tubular passage passing through a needle valve of the pressurized can and an air inlet of the spray tube mounting seat, and on the spray head seat 20, other top face of the dual-erected ringed fork bodies are formed and on the center line of the through slot, a spray tube receiving slot is provided, and the horizontal height of the bottom of the slot is lower than the top end of a ring hole of the fork body, and one tube end of the spray tube is a roller body constantly adhered to the top face of the spray tube mounting seat, and the two lateral sides of the tube ends are provided with shafts inserted into the dual-erected ringed fork body, and the interior of the spray tube is provided with two spray passages having air inlets being mounted at the two ends of the roller perpendicular to the tube body of the spray tube which in communication with air outlet which is switched at the top face of the spray tube mounting seat, and the air outlets are plugged with a spray head respectively mounted at the tube opening of the two ends of the spray tube.

Yet another object of the present invention is to provide a multi-functional finger-press structure of a spray can, wherein the face of the spray tube recessed slot is again provided with a recessed slot.

Still another object of the present invention is to provide a multi-functional finger-press structure of a spray can, wherein the spray head is fine radius ejector having a spray outlet is formed integrally with the spray head.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
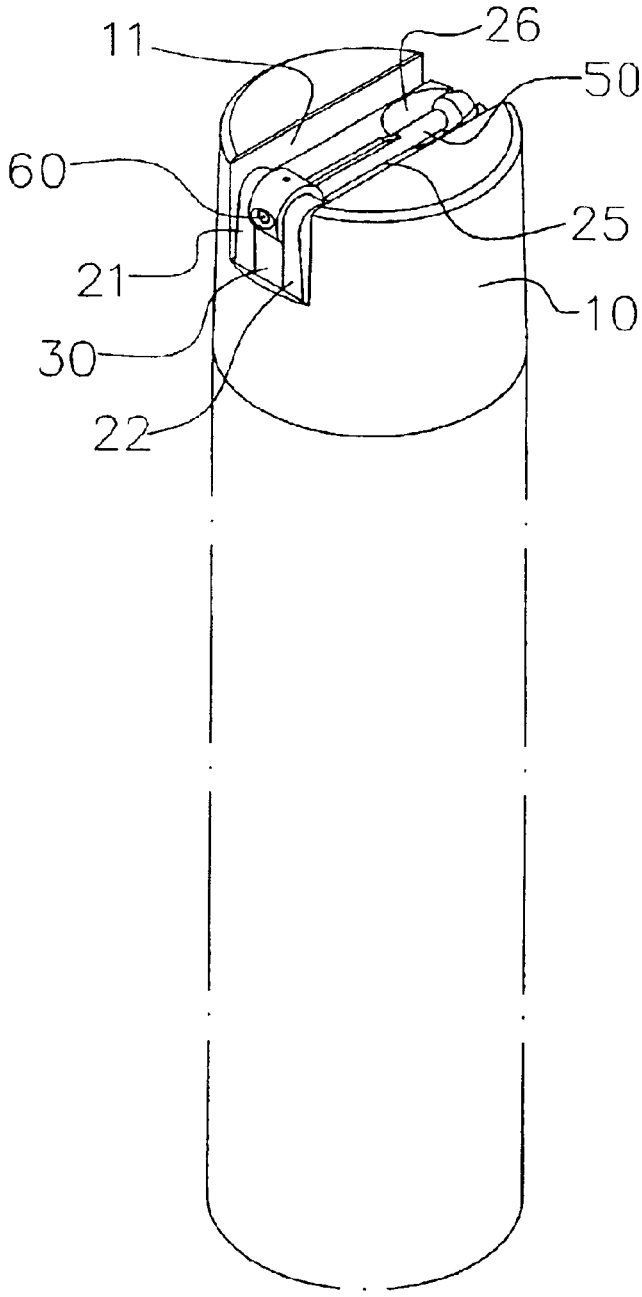
FIG. 1 is a perspective view of a multi-functional finger-press structure of a spray can in accordance with the present invention.
Figure 2:
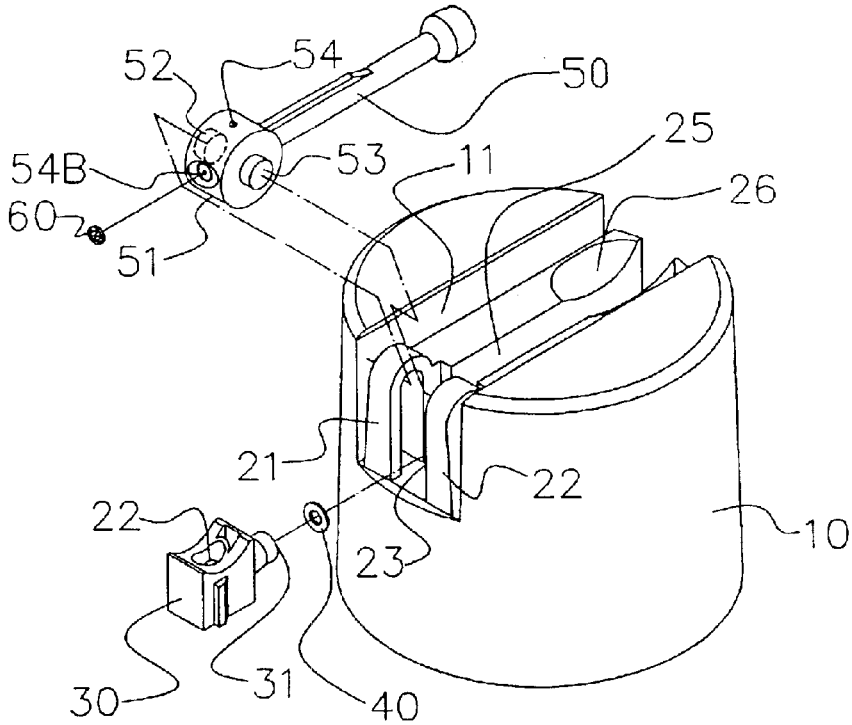
FIG. 2 is a perspective exploded view of a multi-functional finger-press structure of a spray can in accordance with the present invention.
Figure 3:
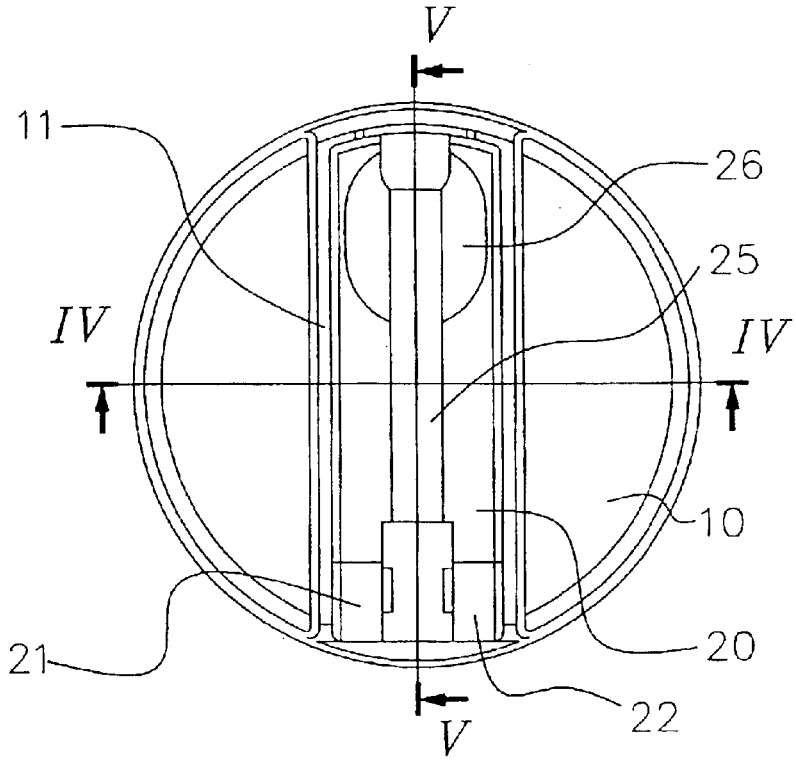
FIG. 3 is a top view of a multi-functional finger-press structure of a spray can of the present invention.
Figure 4:
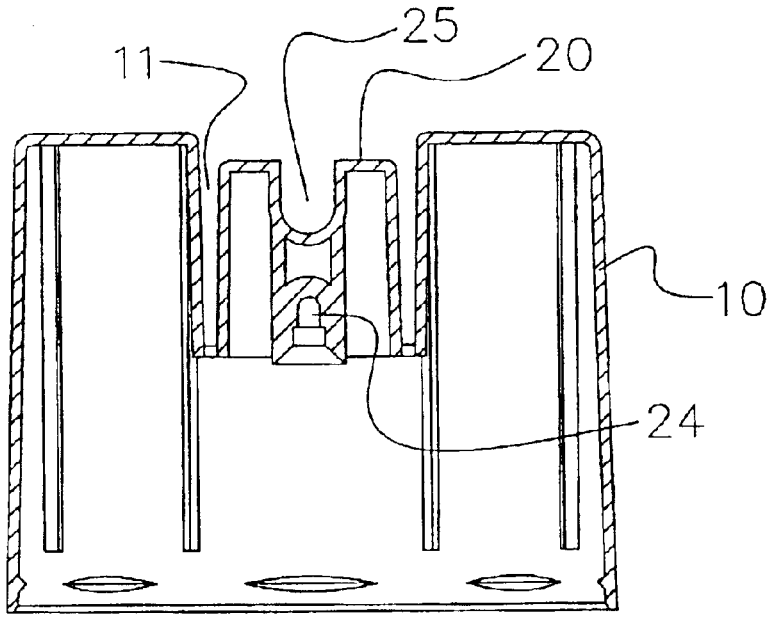
FIG. 4 is a sectional view along line IV—IV of FIG. 3.
Figure 5:
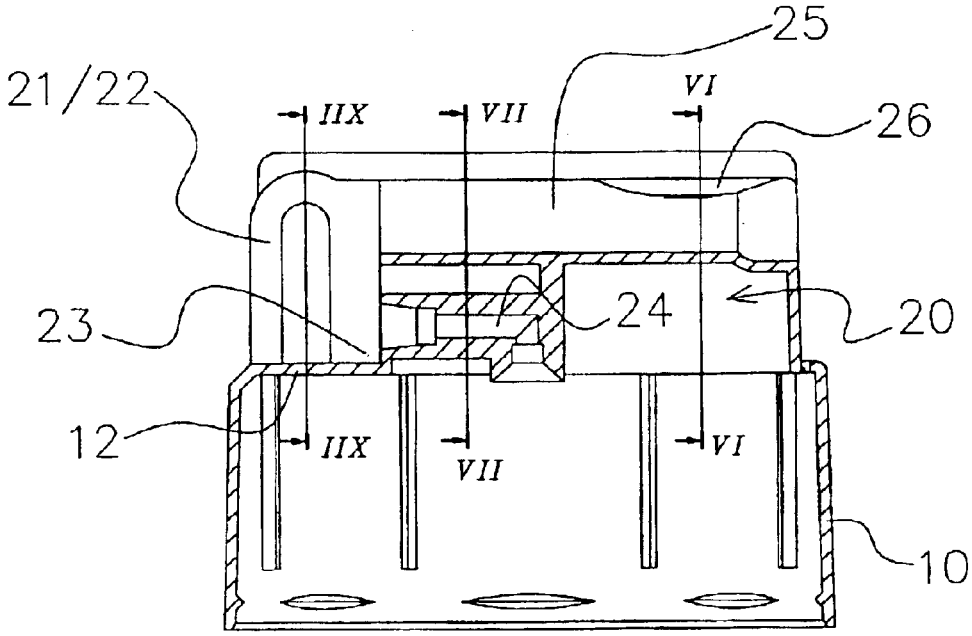
FIG. 5 is a sectional view along line V—V of FIG. 3.
Figure 6:
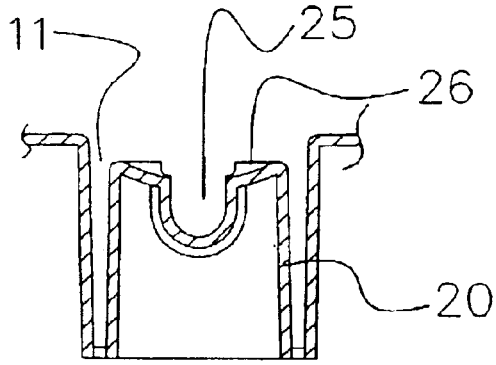
FIG. 6 is a sectional view along line VI—VI of FIG. 3.
Figure 7:
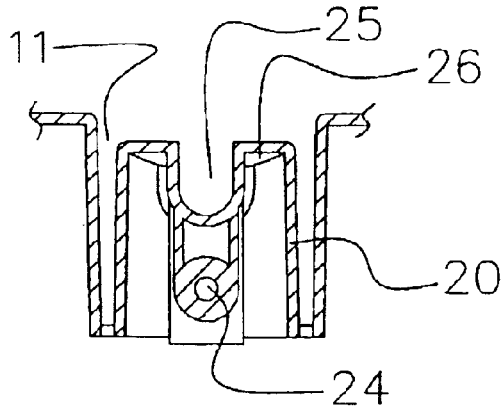
FIG. 7 is a sectional view along line VII—VII of FIG. 3.
Figure 8:
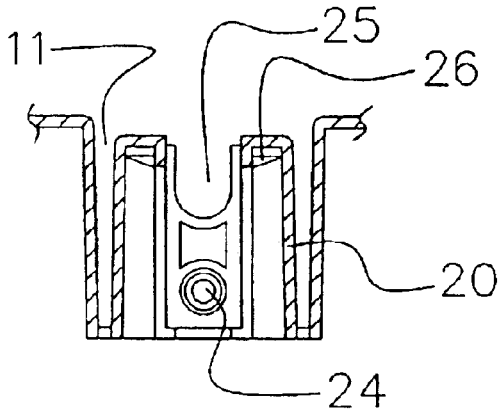
FIG. 8 is a sectional view along line VIII—VIII of FIG. 3.
Figure 9:
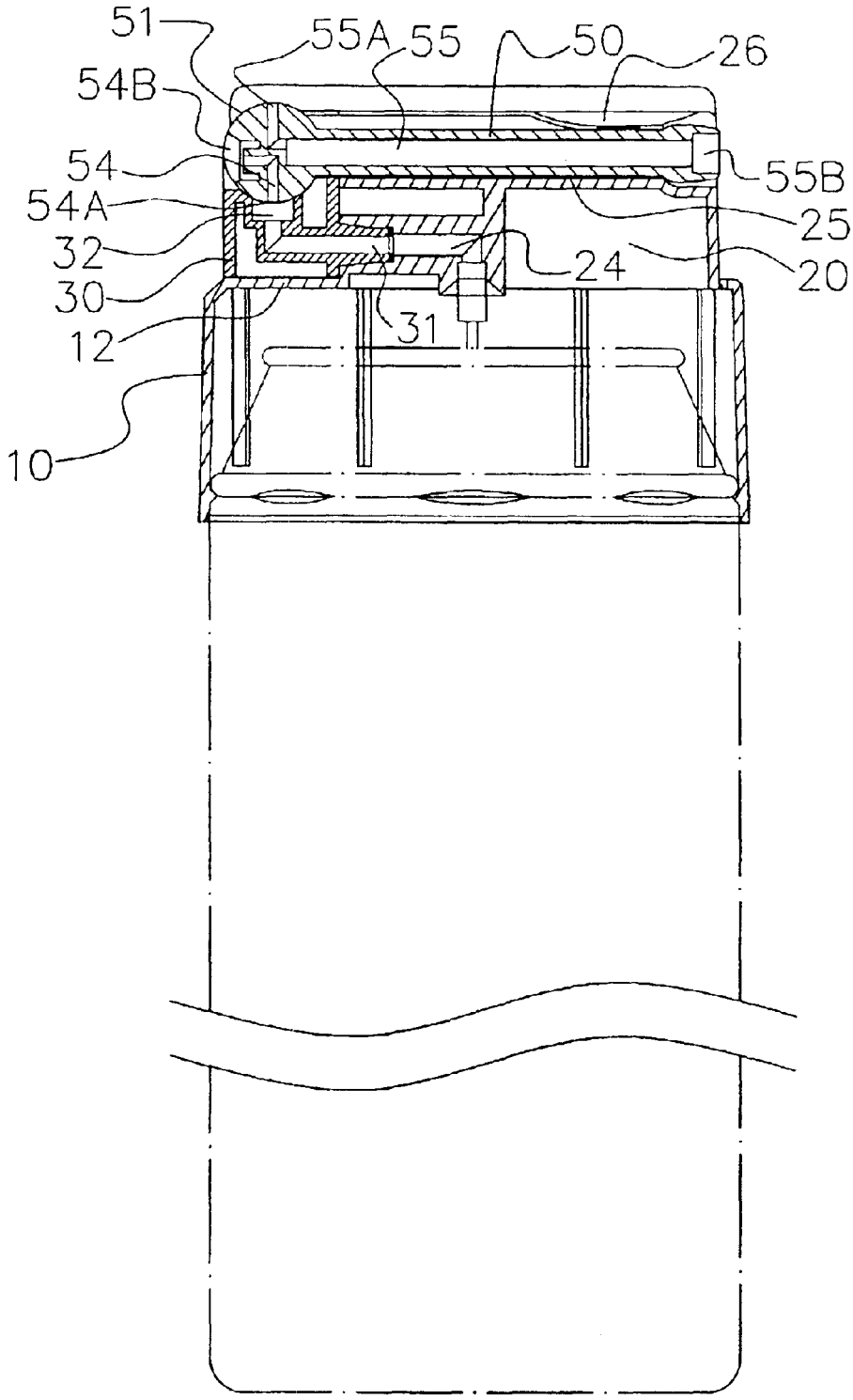
FIG. 9 is a sectional view showing the keeping of the spray tube of the multi-functional finger-press structure of a spray can of the present invention.

Referring to FIG. 1, there is shown a perspective view of a multi-functional finger-press structure of a spray can, and FIG. 2 is a perspective exploded view of the present invention. FIG. 3 is the top view of the invention and FIGS. 4, 5, 6, 7 and 8 are sectional views of the present invention. The multi-functional finger-press structure of a spray can comprises a pressurized can spray cap 10, a spray head seat 20, a spray tube mounting seat 30, a sealing pad 40, a spray tube 50, and at least one to two spray heads 60. The top of the pressurized can spray cap 10 is a recessed horizontal through slot 11 having the inner edge of one end thereof connected by a connection arm 12 to the spray head seat 20. The spray head seat 20 facing one end of the connection arm 12 is formed into a dual-erected ringed fork body 21 having an abdomen portion 23 mounted with the sealing pad 40 being plugged into the spray tube mounting seat 30. The interior of the spray head seat 20 is formed into a tubular passage 24 passing through a needle valve (not shown) of the pressurized can and an air inlet 31 of the spray tube mounting seat. On the spray head seat 20, other top face of the dual-erected ringed fork bodies 21, 22 are formed. The center line of the through slot 11, a spray tube receiving slot 25 is provided. The horizontal height of the bottom of the slot 25 is lower than the top end of a Ting hole of the fork body 21, 22. One tube end of the spray tube 50 is a roller body 51 constantly adhered to the top face of the spray tube mounting seat 30. The two lateral sides of the tube ends are provided with shafts 52, 53 inserted into the dual-erected ringed fork body 2 1, 22 as shown in FIG. 9. The interior of the spray tube 50 is provided with two spray passages 54 shown in FIG; 11 having air inlets 54A, 55A being mounted at the two ends of the roller 51 perpendicular to the tube body of the spray tube 50 which in communication with air outlet 32 which is switched at the top face of the spray tube mounting seat 30, and the air outlets 54B, 55B are plugged with a spray head 60 respectively mounted at the tube opening of the two ends of the spray tube 50. The spray head 60 is one with a fine hole radius which can be formed as one body with the spray air outlets 54B, 55B of the spray passage 54. When the spray tube 50 is folded back to the slot 25, the spray tube 50 is hidden and kept in the slot 25.

Figure 10:
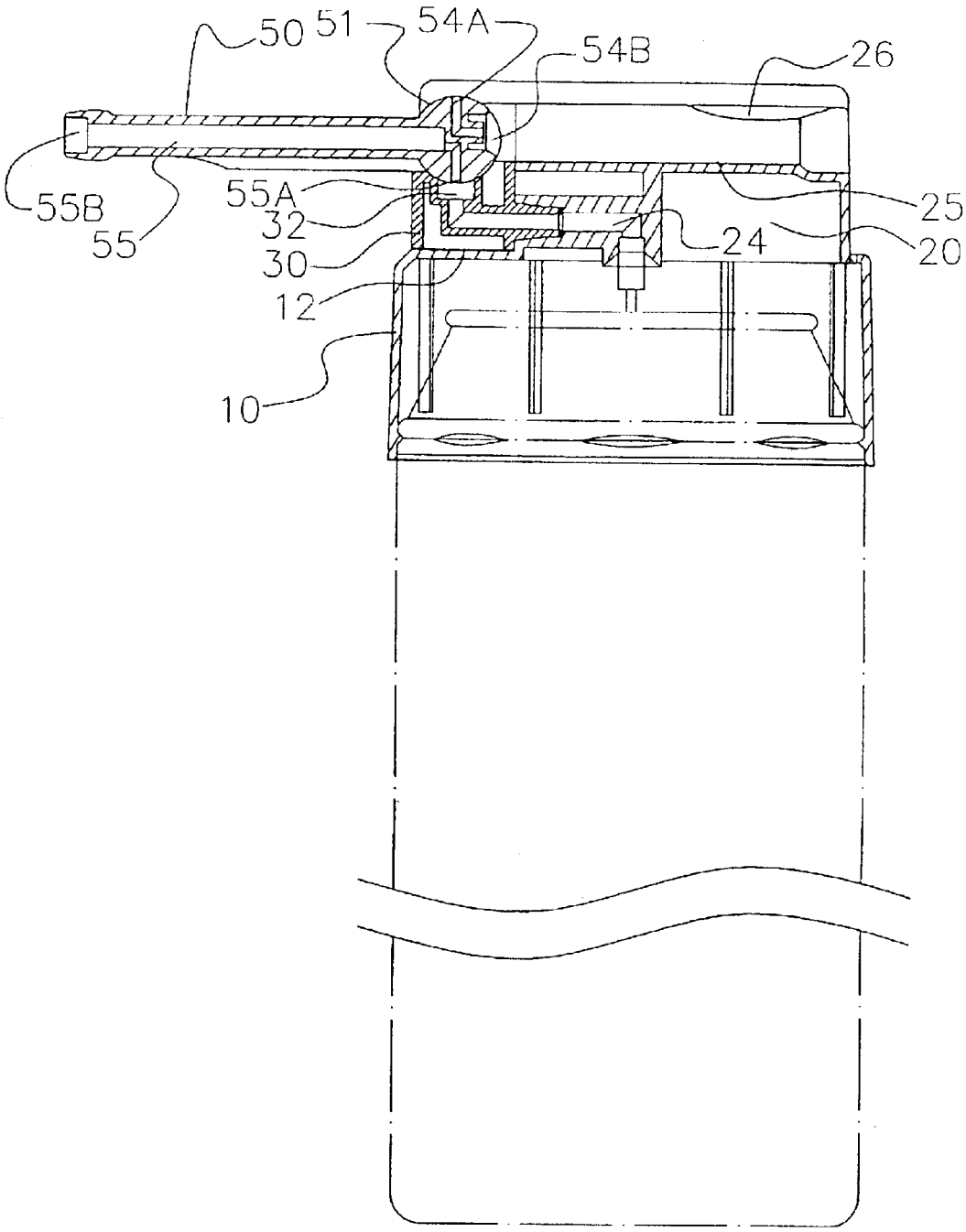
FIG. 10 is a schematic view showing the extension of the spray tube of the multi-functional finger-press structure of a spray can in accordance with the present invention.
Figure 11:
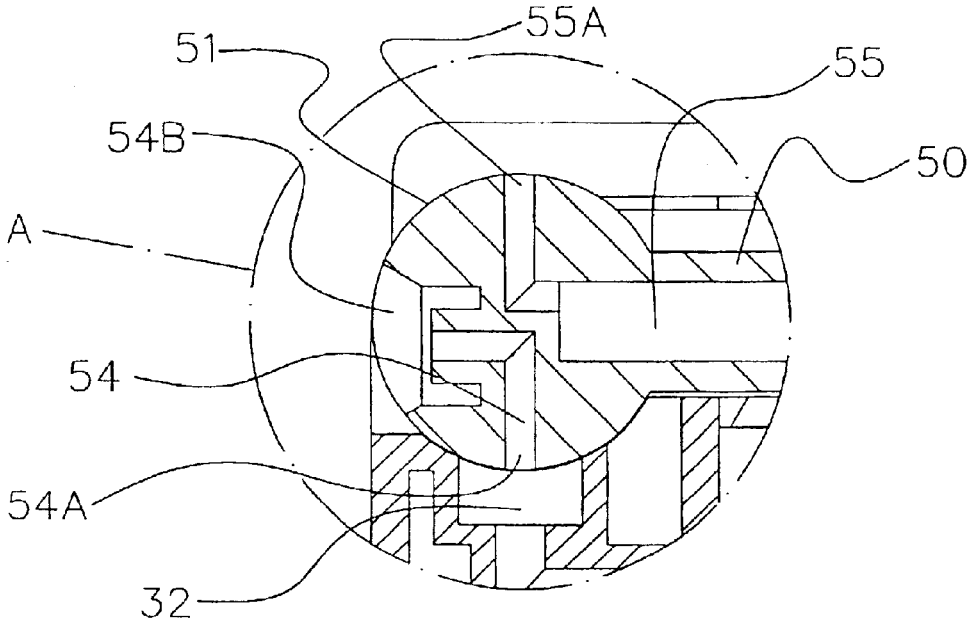
FIG. 11 is an enlarged view of the part designated as A of FIG. 9.
Figure 12:
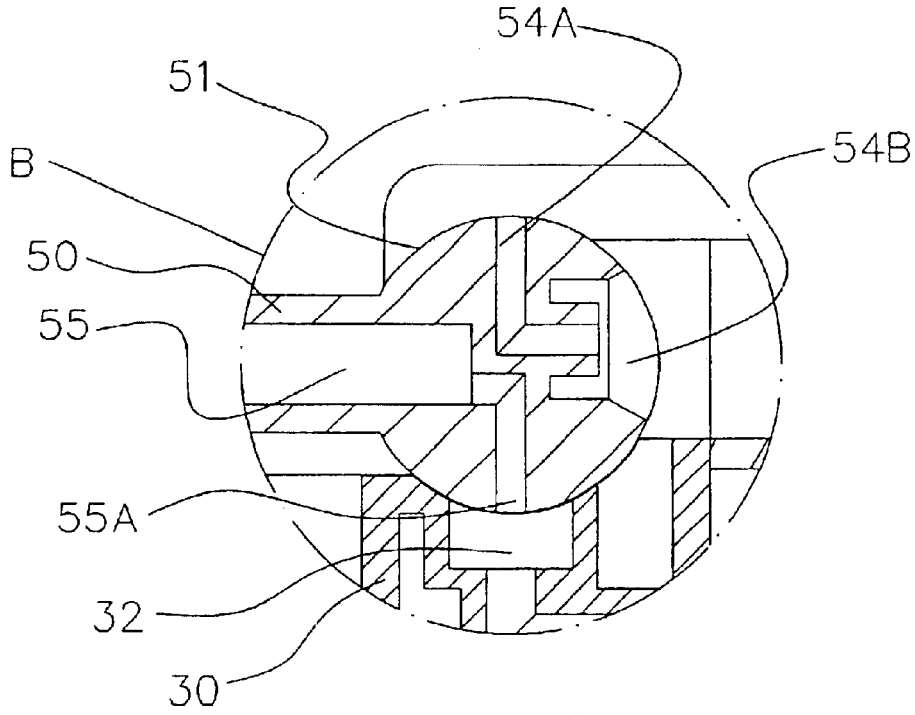
FIG. 12 is an enlarged view of the part designated as B of FIG. 10.

Referring to FIG. 9, when the spray tube 50 is held in the slot 25 and the force-exerting recess 26 at the top section of the slot 25 is pressed, the spray solution shall be discharged from the spray outlet 54B, which provides a wider range of spraying with short spray hole, or as shown in FIG. 10. As shown in FIG. 12, when the spray tube 50 is turned from the slot 25 at an angle of 180 degree, and the force-exerting recess 26 at the top section of the slot 25 is pressed, the spray solution will be discharged from the spray outlet 55B, which can be used to spray narrow slit by extending the spray tube. To change wider range of spraying, the spray tube 50 is turned back to 180 degree at opposite direction to the slot 25, returning to that shown in FIG. 9.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A multi-functional finger-press structure of a spray can comprising a pressurized can spray cap, a spray head seat, a spray tube mounting seat, a sealing pad, a spray tube, and at least one to two spray heads, characterized in that the top of the pressurized can spray cap is a recessed horizontal through slot having the inner edge of one end thereof connected by a connection arm to the spray head seat, the spray head seat facing one end of the connection arm is formed into a dual-erected ringed fork body having an abdomen portion mounted with the sealing pad being plugged into the spray tube mounting seat, and the interior of the spray head seat is formed into a tubular passage passing through a needle valve of the pressurized can and an air inlet of the spray tube mounting seat, and on the spray head seat, other top face of the dual-erected ringed fork bodies are formed and on the center line of the through slot, a spray tube receiving slot is provided, and the horizontal height of the bottom of the slot is lower than the top end of a ring hole of the fork body, and one tube end of the spray tube is a roller body constantly adhered to the top face of the spray tube mounting seat, and the two lateral sides of the tube ends are provided with shafts inserted into the dual-erected ringed fork body, and the interior of the spray tube is provided with two spray passages having air inlets being mounted at the two ends of the roller perpendicular to the tube body of the spray tube which in communication with air outlet which is switched at the top face of the spray tube mounting seat, and the air outlets are plugged with a spray head respectively mounted at the tube opening of the two ends of the spray tube.

2. The multi-functional finger-press structure of a spray can of claim 1, wherein the top face of the spray tube recessed slot is again provided with a recessed slot.

3. The multi-functional finger-press structure of a spray can of claim 1, wherein the spray head is fine radius ejector having a spray outlet is formed integrally with the spray head.

* * * * *